United States Patent [19]

Heitner

[11] 4,070,896

[45] Jan. 31, 1978

[54] PRESS BRAKE WITH IMPROVED RAM LEVELING ADJUSTMENT

[75] Inventor: Raymond J. Heitner, Greensboro, N.C.

[73] Assignee: Wysong & Miles Company, Greensboro, N.C.

[21] Appl. No.: 746,799

[22] Filed: Dec. 2, 1976

[51] Int. Cl.[2] ..... B21D 7/06

[52] U.S. Cl. ..... 72/389; 72/450; 72/446

[58] Field of Search ..... 72/450, 441, 389, 386, 72/443, 446, 448; 100/257, 258 R, 258 A

[56] References Cited

U.S. PATENT DOCUMENTS

| | | | |
|---|---|---|---|
| 1,422,779 | 7/1922 | Perony | 72/450 |
| 1,694,585 | 12/1928 | Dreis | 72/448 |
| 2,136,856 | 11/1938 | Long | 72/446 |
| 2,237,170 | 4/1941 | Williamson | 72/450 |
| 2,946,234 | 7/1960 | Jahnke | 100/257 |
| 3,162,232 | 12/1964 | Munschauer | 72/441 |
| 3,587,286 | 6/1971 | Fritsch | 72/389 |
| 3,763,690 | 10/1973 | Kirincic | 72/447 |

FOREIGN PATENT DOCUMENTS

| | | | |
|---|---|---|---|
| 790,402 | 2/1958 | United Kingdom | 72/446 |

*Primary Examiner*—C.W. Lanham
*Assistant Examiner*—Gene P. Crosby

[57] ABSTRACT

A press brake having improved ram leveling adjustment is disclosed. The press brake is preferably one having a hydraulic-mechanical power actuator for advancing and returning the ram. The power actuator includes a pair of bell cranks pivotally supported on an upright frame by a pair of horizontally spaced pivots, a hydraulic piston and cylinder motor for oscillating one of the bell cranks, and a link connecting like arms of the bell crank for causing parallel motion of the bell cranks. Leveling adjustment of the ram is obtained by providing horizontally spaced parallel links which are independently adjustable in length to interconnect the ram and second like arms of the bell cranks. An independently controlled reversible motor is operatively associated with each adjustable link for selectively lengthening or shortening the link, and an indicator is associated with each link to indicate position adjustment of each link.

7 Claims, 9 Drawing Figures

13
15
24
22
21
43
38
28
26''
26'
37
33''
33
34
35
33'
36
30
44
32
29
27''
27'
14
37'
26
26a
31
40
41
72
42
27
27a

PRESS BRAKE WITH IMPROVED RAM LEVELING ADJUSTMENT

BACKGROUND OF THE INVENTION

This invention relates to a press brake with improved ram leveling adjustment and more particularly to a press brake having hydraulic-mechanical power means for advancing and returning a ram and separate leveling means for independently adjusting the level of each end of the ram.

The correct angular adjustment or level of the moving ram of a press brake is important in precision work such as in the bending of heavy sheet and bar metals. The size and weight of a press brake increases with the thickness of the metal which the press brake is designed to bend and machines of three hundred tons or greater are not uncommon. Efficient production requires that the press brake, even though of great size and weight, be capable of rapid adjustments inorder to reduce set-up time of the machine to a minimum.

Press brakes having hydraulic mechanical power means for advancing and returning a ram relative to a stationary bed are disclosed in the prior art, as for example in U.S. Pat. No. 3,763,690 issued Oct. 9, 1973 to Joseph A. Kirincic and Raymond J. Heitner, and assigned to Dreis and Krump Manufacturing Co. The press brake disclosed in the aforesaid patent has leveling adjustment means for the ram which includes substantially parallel, linked bell cranks, each having a pivot at the fulcrum thereof by which the bell crank is pivotally supported to the frame of the press brake and at least one of the bell cranks having a pivot which includes an eccentric pivot pin which can be rotated to a desired position for ram leveling adjustment. The eccentric is rotated by means of a worm gear which is driven by a manually actuated crank.

It is further known in the prior art to adjust the position of the ram of a press brake with respect to a bed by simultaneously varying the length of a pair of pitmen which support opposite sides of the ram from mechanical operating mechanism. U.S. Pat. No. 2,237,170 issued Apr. 1, 1941 to Larkin R. Williamson and assigned to E. W. Bliss Company discloses a machine having the aforesaid capability. The adjusting means comprises an electric motor which drives a telescoping shaft extending across the ram and connected at each end into the pitman construction at the ends of the ram. A pair of worms are carried at the ends of the shaft and each engages respectively with a worm wheel keyed to each lower pitman element. Each of the pitmen comprises a lower pitman element swiveled in a socket at one end of the ram and an upper pitman element comprising an internally threaded sleeve, one end of which is pivotally connected to an eccentric for raising and lowering the press brake ram. Thus depending on the direction in which the motor driven shaft rotates the lower pitman elements at each end of the ram, the pitmen will be shortened or lengthened, and the ram is raised or lowered with regard to the upper pitman structure to adjust the ram with respect to the stationary bed.

SUMMARY OF THE INVENTION

It is an object of this invention to provide a press brake having improved leveling adjustment means in its ram advancing and retracting means whereby the angular adjustment of a ram with respect to a stationary bed may be rapidly and easily performed.

It is a further object of this invention to provide leveling adjustment means for a press brake whereby each end of the ram may be leveled by separate and independently controlled leveling means.

It is still another object of this invention to provide separate and independently controlled motor means to level each end of the press brake ram with respect to a stationary bed.

It is still another object of this invention to provide a press brake comprising an upstanding frame, a ram having opposite ends and hydraulic-mechanical power means for advancing and retracting the ram, the power means including a pair of bell cranks each of which includes a fulcrum and first and second angularly related arms extending from the fulcrum, a pair of horizontally spaced pivots for pivotally supporting the bell cranks about their fulcrums from the frame, a link pivotally interconnecting the first arm of the bell cranks for causing substantially parallel motion of the bell cranks, a pair of adjustable links each pivotally supporting said ram from the second arm of a different one of the bell cranks, each link of the pair of adjustable links being independently adjustable in length for leveling the ram, and independently controlled reversible motor means for selectively lenthening and shortening each of the adjustable links to level the ram.

It is still another object of this invention to provide an improved leveling adjustment means for press brakes of all tonnages.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which.

DETAILED DESCRIPTION OF THE PREFERRED EMBODIMENT

Figure 1:
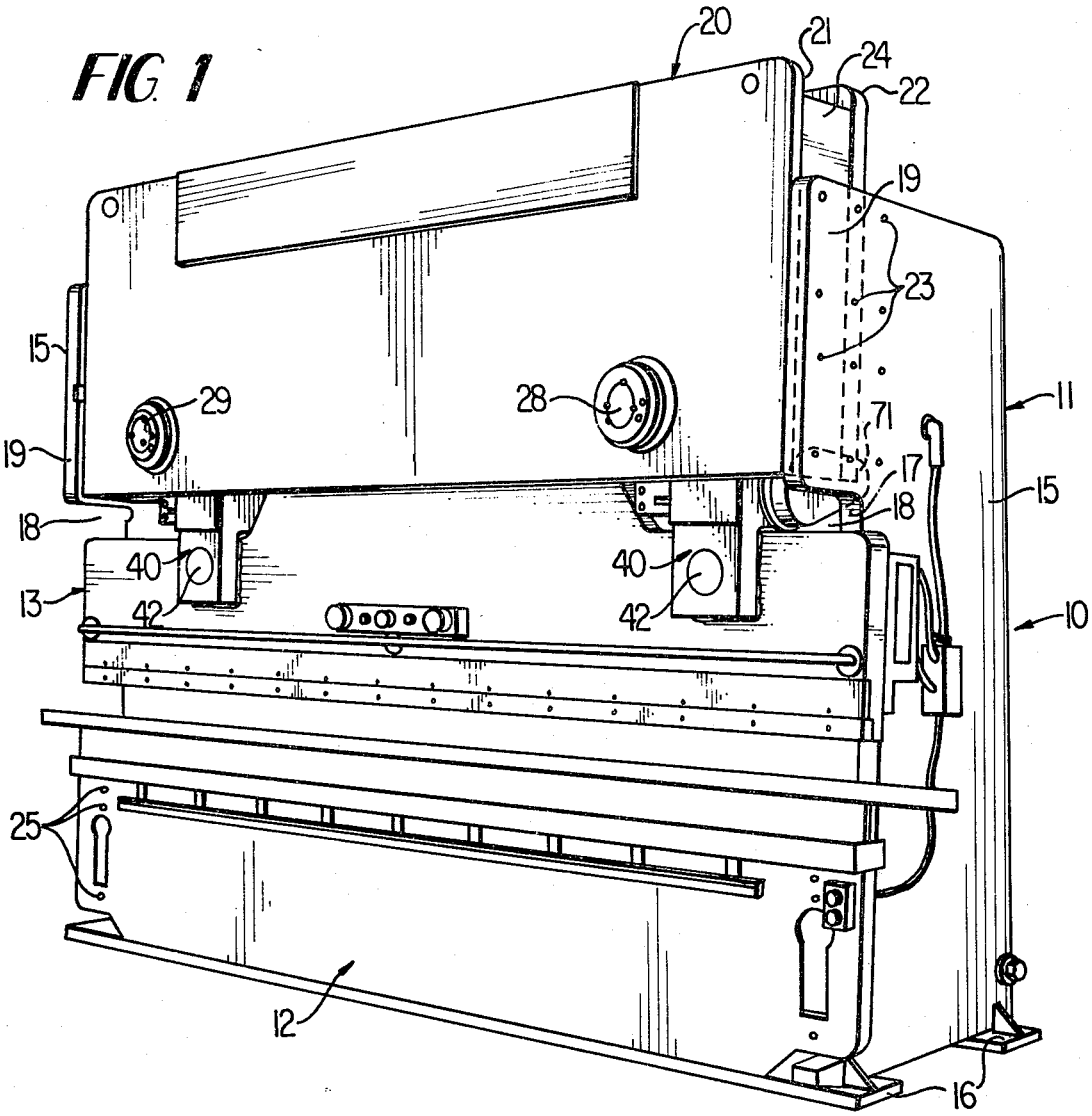
FIG. 1 is a perspective view of an improved press brake in accordance with this invention.

Referring to the drawings, a press brake is generally indicated at 10. The press brake 10 comprises a frame generally indicated at 11, a stationary bed generally indicated at 12, a ram generally indicated at 13, and hydraulic-mechanical power means generally indicated at 14 in FIG. 2 for advancing and retracting the ram 13 relative to the stationary bed 12.

The frame 11 includes massive steel upright side plates 15,15 which are substantially parallel and located at opposite sides of the frame. The side plates 15,15 are supported on an underlying supporting surface by means of feet 16,16 which are welded to opposite bottom corners of the side plates. A major portion of the front edge of the side plates 15,15 is off-set inwardly as at 17. The inwardly offset edges 17 provide recesses 18,18 within the side plates 15,15 wherein the stationary bed 12 is mounted and wherein the ram 13 reciprocates vertically relative to the stationary bed 12. The upper front portions 19 of the side frames 15,15 overhang the recesses 18 and provide support for a crown indicated generaly at 20. The crown comprises substantially parallel transverse crown plates 21 and 22 which are vertically oriented and are secured in horizontally spaced relationship, front and rear, between the side plate front top portions 19,19 by stud bolts 23 extending through the side plates and into threaded sockets (not shown) provided in the ends of the crown plates. At opposite ends of the crown are end plates 24,24 which extend transversely between the crown plates 21 and 22 and are welded thereto to provide a rigid box-like structure which is open at its top and bottom. The crown 20 is adapted to be detached from the remainder of the press brake frame by removing the bolts 23 for facilitating shipment of the press brake. The stationary bed 12 is likewise bolted rigidly to the front edges 17,17 of the side plates 15,15 by bolts 25 at opposite ends of the bed 12. The heads of the bolts 25 are preferably recessed flush with the front surface of the bed 12 to provide a smooth surface.

The bed 12 and the ram 13 are of generally conventional structure and need not be described in detail. It will be understood, however, that the upper edge of the bed 12 and the lower edge of the ram 13 are provided with die holders for selectively mounting appropriate dies for bending metal.

Looking now at FIGS. 2–5, the power means 14 for advancing and retracting the ram 13 is shown in detail.

Figures 2, 3:
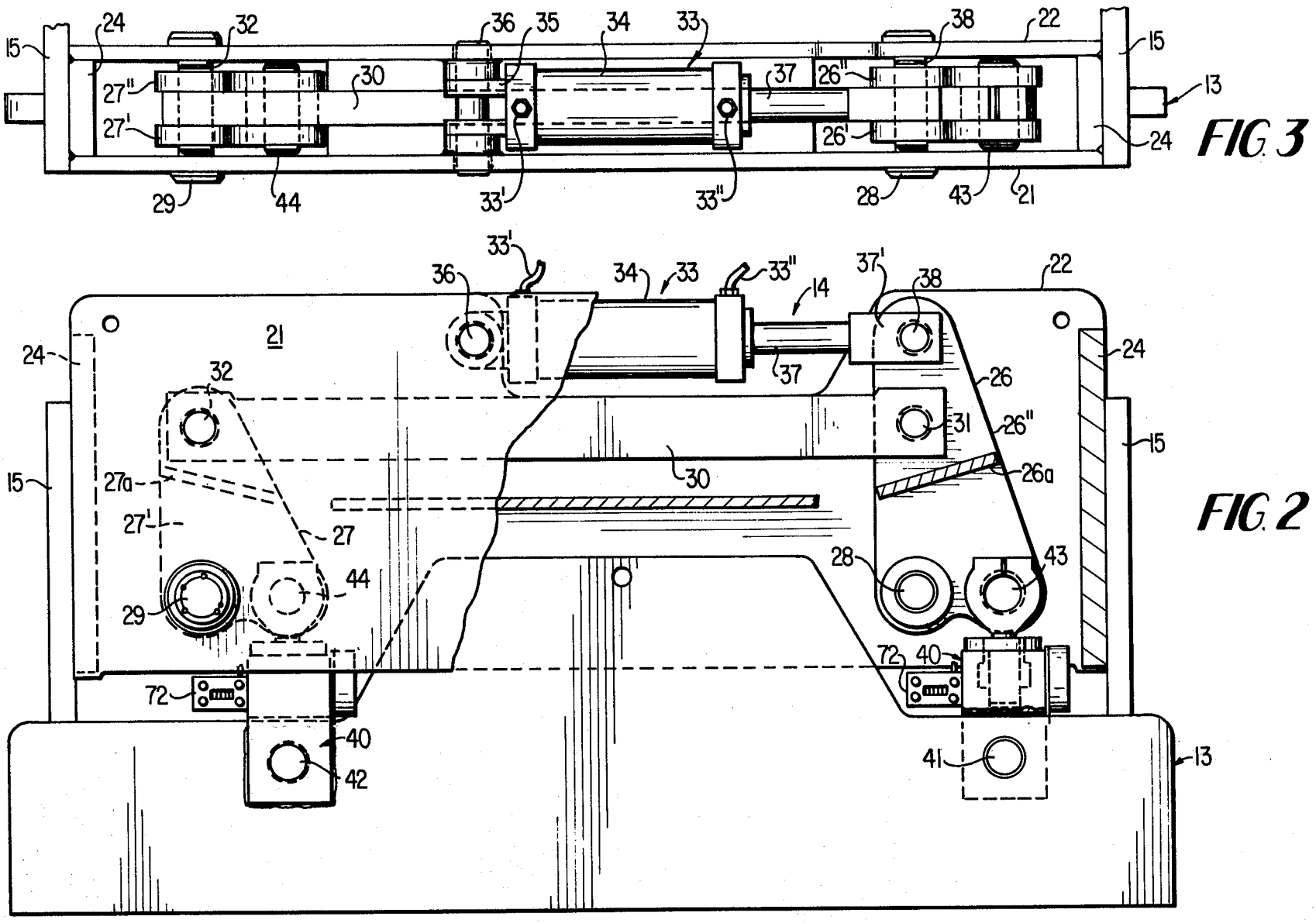
FIG. 2 is a front elevational view with parts broken away showing the upper portion of the press brake illustrated in FIG. 1 including the crown portion of the brake press frame, the ram and the hydraulic-mechanical power means for advancing and retracting the ram and showing the ram in its "down" postion.
FIG. 3 is a top plan view of the hydraulic-mechanical power means shown in FIG. 2 with the supporting frame structure only partially shown.
Figure 4:
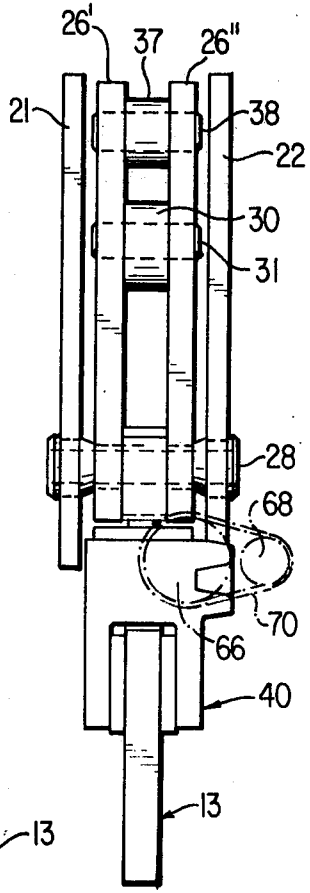
FIG. 4 is a right-hand end view of the hydraulic-mechanical power means and ram shown in FIG. 2 omitting portions of the frame to expose the operating parts.

The power means 14 includes a pair of bell cranks 26 and 27 which are pivotably supported between the front and rear crown plates 21 and 22 of the frame by means of horizontally spaced pivot pins 28 and 29 respectively, a tie link 30 pivotally connected at its opposite ends to the bell cranks 26 and 27 by pivot pins 31 and 32 respectively, a double acting hydraulic reciprocating motor 33 comprising a cylinder 34 pivotally connected at one end by ears 35,35 and pivot pin 36 between crown plates 21 and 22, and a piston (not shown) with piston rod 37 extending from the cylinder 34 and pivotally connected to the bell crank 26 by clevis 37' and pivot pin 38, and a pair of adjustable links 40,40 which are pivotally connected to opposite ends of the ram 13 by pivot pins 41 and 42 respectively. The right hand adjustable link 40 as seen in FIG. 2 is connected to the bell crank 26 by a pivot pin 43 while the left hand adjustable line 40 is connected to the bell crank 27 by a pivot pin 44.

The bell crank 26 comprises a pair of generally right triangle-shaped plates 26' and 26'' which are rigidly connected side by side in spaced parallel relationship by a transverse plate **26*a*. Bell crank 26 is pivoted about the pivot pin 28, which forms the fulcrum for a first lever arm including the portions of the plates 26' and 26'' on which imaginary lines connecting the centers of pivot pins 28 and 31 are located, and a second lever arm including the portions of the plates 26' and 26'' on which imaginary lines connecting the centers of pivot pins 28 and 43 are located. The angle between the first and second lever arms of bell crank 26 is substantially ninety degrees. The first lever arm of bell crank 26 is extended substantially above the center of pivot pin 31 and thus provides an extended lever arm to which the hydraulic motor piston rod 37 is connected by the pivot pin 38**.

The left hand bell crank 27 also comprises a pair of generally right triangle-shaped plates 27' and 27'' which are rigidly connected side by side in spaced parallel relationship by a transverse plate **27*a*. The bell crank 27 is pivoted about the pivot pin 29 which is the fulcrum for a first lever arm including portions of plates 27' and 27'' on which imaginary lines connecting the centers of pivot pins 29 and 32 are located and a second lever arm including the portions of plates 27' and 27'' on which imaginary lines connecting the centers of pivot pins 29 and 44 are located. The first and second lever arms of bell crank 27 make an angle of substantially 90° between them, and they correspond to the first and second lever arms respectively of bell crank 26. The distance between the centers of pivot pins 28 and 31 on bell crank 26 is substantially equal to the distance between the centers of pivot pins 29 and 32 of bell crank 27. Likewise the distance between the centers of pivot pins 28 and 43 of bell crank 26 is substantially equal to the distance between the centers of pivot pins 29 and 44 of bell crank 27. The tie link 30 is of such a length so that the distance between the centers of the pivot pins 31 and 32 is substantially equal to the distance between the centers of pivots 28 and 29 of the respective bell cranks 26 and 27 and thus it provides parallel motion of one bell crank with respect to the other. The horizontally spaced centers of pivots 28 and 29 are at substantially the same level from the bottom of the frame 11**.

Figure 6:
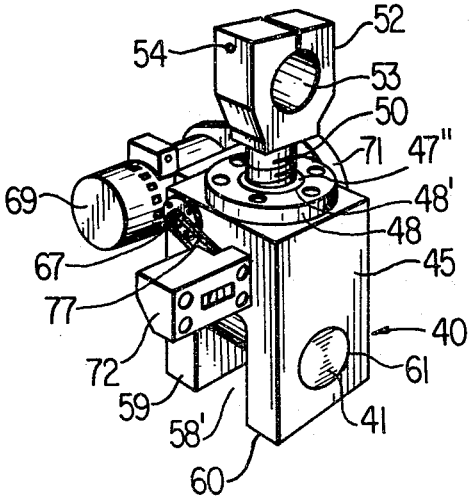
FIG. 6 is an enlarged perspective view of one of the two adjustable links shown in FIG. 2 connecting the ram to the bell cranks of the hydraulic-mechanical power means.
Figure 7:
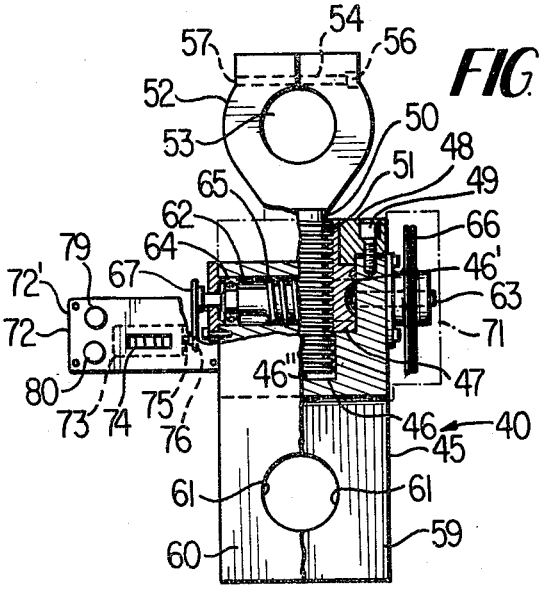
FIG. 7 is an enlarged front elevational view partially in vertical section of the adjustable link shown in FIG. 6.

In FIGS. 6 and 7, details of the two similar adjustable links 40,40 are shown. Each of the adjustable links 40,40 includes a block-like pitman 45 having an axially inwardly extending socket 46 at one end, a threaded nut 47 rotatably mounted within the socket 46, a retaining plate 48 secured to the top of the pitman 45 by recessed cap screws 49 for retaining the nut 47 within the socket 46 against axial displacement and a level adjusting screw 50. The level adjusting screw 50 includes an externally threaded shank 51 which threadedly engages the rotatable nut 47 within the socket 48 and a split yoke 52 above the shank which is provided with a circular opening 53 for pivotally connecting the level adjusting screw to one of the pivot pins 43 or 44 extending through the bell cranks 26 and 27 respectively. A transverse bore 54 is provided through the split portion of the yoke 52 above the opening 53 to receive a headed bolt 55 (FIG. 5) with an externally threaded shank. The bore 54 includes an enlargement 56 at one end to receive the head of the bolt 55 and is threaded at its opposite end at 57 for threadedly engaging the bolt 55. The bolt 55 may be turned within the bore 54 for tightening or loosening the yoke relative to a pivot pin extending through the opening 53.

Figure 8:
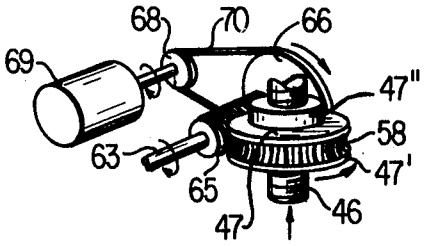
FIG. 8 is a schematic diagramatic view showing in perspective the drive means for turning the leveling nut within the adjustable link shown in FIGS. 6 and 7.
Figure 5:
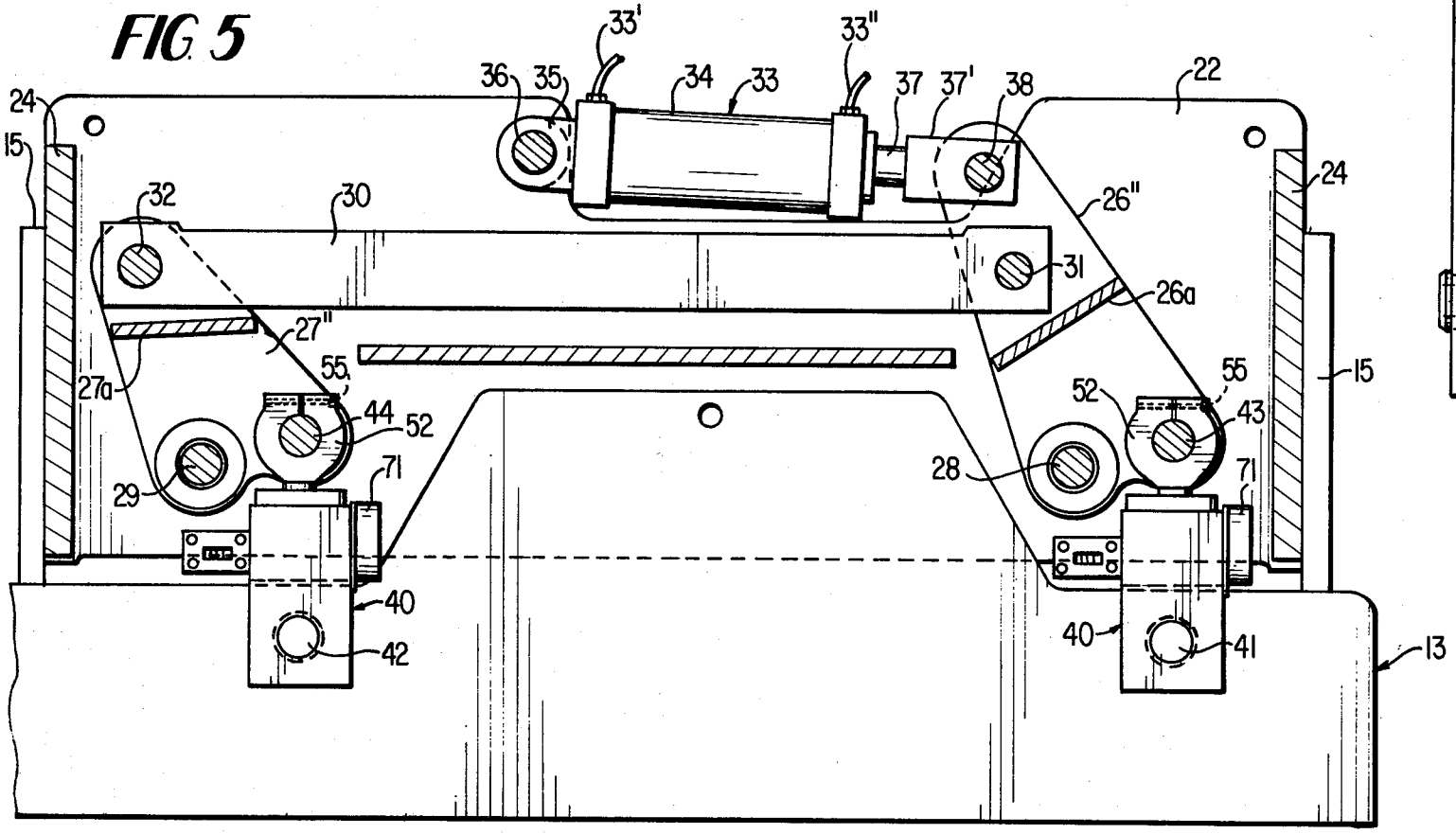
FIG. 5 is a view similar to FIG. 2 but with the front crown plate removed, and showing the ram in its "up" position.

The level adjusting nut 47 includes an enlarged cylindrical bottom portion 47′ provided with external gear teeth 58 (see FIG. 8), and a reduced diameter cylindrical upper portion 47″ coaxial with the bottom portion 47′. The socket 46 includes an enlarged cylindrical recess 46′ for rotatably receiving the enlarged bottom portion 47′ of the nut 47 and a reduced cylindrical portion 46″ below the enlarged portion 46′ for receiving the shank 51 of the level adjusting screw 50. The retaining cap 48 has a bore 48′ slightly larger than the diameter of the reduced cylindrical portion 47″ of the level adjusting nut 47 and an annular bottom flange which fits between the reduced portion of the nut 46 and the enlarged portion of the socket 46 and terminates adjacent the upper surface of the enlarged portion 47′ of the nut 47 so as to permit rotation of the nut and at the same time to prevent axial displacement of the nut.

The end of the pitman 45 opposite the socket 46 includes a pair of parallel ears 59 and 60 separated by a transverse slot 58′, and aligned apertures 61,61 in opposite ears for receiving one of the pivot pins 41,42 therethrough. The slot 58′ is of sufficient width and depth to permit the slotted end of the link 40 to fit over the upper edge of the ram 13 with the ears 59 and 60 straddling opposite sides thereof. The apertures 61,61 in the opposite ears of the separate links 40,40 are aligned with longitudinally spaced apertures (not shown) through the ram near its upper edge to receive the pivot pins 41 and 42 for pivotally connecting the right and left hand links 40,40 to the ram.

A transverse cylindrical bore 62 is provided through the pitman 45 so as to intersect with a radially outer portion of the enlarged cylindrical portion 46′ of the socket 46. A worm shaft 63 is rotatably mounted within the bore 62 by suitable antifriction bearings 64 (only one shown) at opposite ends of the bore. The worm shaft 63 has worm teeth 65 which engage with the worm teeth on the nut 47. On one end of the worm shaft 63 is fixedly mounted a large diameter input sprocket wheel 66, and on the other end of the worm shaft is fixedly mounted a small diameter sprocket wheel 67. The input sprocket wheel 66 is driven from the output sprocket 68 fixed on the shaft 69′ of a reversible electric motor 69 through a sprocket chain 70 interconnecting the sprockets 66 and 68. The motor 69 is supported by appropriate support means (not shown) on one side of the pitman 45. A chain guard 71 enclose the chain 70 and sprockets 66 and 68 for safety purposes.

A level indicator 72 is mounted on the side of the pitman opposite to the input sprocket 66. It includes an indicator housing 72′ within which is mounted a zero set digital revolution counter 73, comprising a plurality of digital counter wheels which are exposed to an operator's view through a window 74. A counter input shaft 75 having a sprocket wheel 76 fixed thereon is driven from the sprocket 67 on the end of worm shaft 63 by a sprocket chain 77. The drive sprockets 67 and 76 for the counter 72 are appropriately selected in order to correlate the count accumulated by the counter 72 in response to the rotation of the worm shaft 63 with the position of the screw 50 relative to the nut 47. The position of a pivot pin through the holes 61,61 in the pitman 45 will also be correlated with the count accumulated on the counter 72 because the distance between the center of the holes 61,61 and the nut 47 is fixed.

Mounted on the face of the counter housing 72 are motor control switch buttons 79 and 80 for controlling the leveling motor 69. The button 79 actuates an "up" control switch for causing the motor 69 to rotate in a direction to shorten the link 40 and thus to raise the ram 13. The button 80 actuates a "down" control switch for the motor 69 for causing the motor 69 to rotate in a direction to lengthen the link 40 and thus to lower the ram 13 relative to the bed 12.

Figure 9:
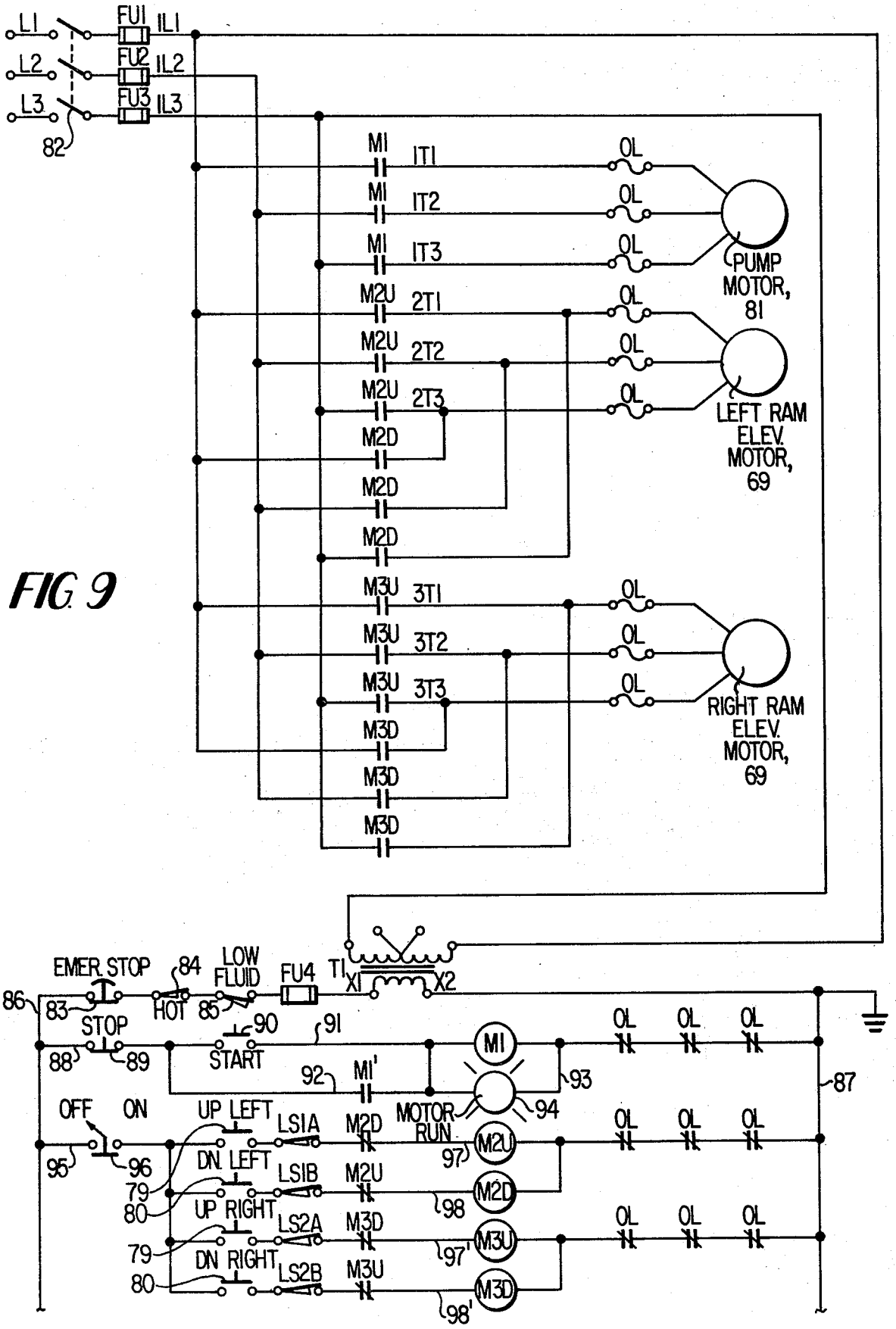
FIG. 9 is an electrical schematic diagram showing the electrical controls for right and left hand ram elevation motors and for the hydraulic fluid pump motor included in the press brake of this invention.

An electrical schematic diagram showing the control circuits for the right and left hand elevation motors 69 and for a hydraulic fluid pump motor 81 is shown in FIG. 9. The pump motor 81 and the right and left ram elevation motors 69 are preferably three phase motors receiving power from the three phase electric power line L1, L2 and L3. A master switch 82 is provided to selectively open or close all of the power lines L1, L2 and L3 simultaneously. Fuses FU1, FU2 and FU3 are provided on the appliance side of the master switch in lines 1L1, 1L2 and 1L3.

The pump motor 81 is connected to lines 1L1, 1L2, and 1L3 through lines 1T1, 1T2 and 1T3 in each of which are located normally open control relay contacts M1 and overload sensing coils OL.

The left ram elevation motor 69 is connected to the lines 1L1, 1L2 and 1L3 through the lines 2T1, 2T2 and 2T3, the three normally open "up" relay contacts M2U, and through the three normally open "down" relay contacts M2D connected in a motor reversing circuit.

The right ram elevation motor 69 is connected to the lines 1L1, 1L2 and 1L3 through lines 3T1, 3T2, and 3T3, the three normally open "up" relay contacts M3U and through the three normally open "down" relay contacts M3D connected in a motor reversing circuit.

The control circuits for the pump and elevation motors receive single phase energy from lines 1L1 and 1L3 through step down transformer T1 which steps the line voltage down appropriately for the control circuits. An emergency stop switch 83, a hydraulic fluid temperature overheat responsive switch 84, a hydraulic "low fluid" responsive switch 85 and a fuse FU4 are preferably provided on the ungrounded side X1 of the secondary winding of transformer T1 in series with the distribution lead 86. The grounded side X2 of the secondary winding of transformer T1 is connected to the common lead 87.

A control circuit 88 for the hydraulic fluid pump motor 81 is connected between the control current lines 86 and 87. It includes a normally closed manually operated "stop" switch 89 and a normally open manually operated "start" switch 90 connected in series circuit 91 with the pump motor control relay M1, and three normally closed overload sensing circuit breaker contacts OL. Each of the overload circuit breaker contacts OL is responsive to an overload sensing device in a different one of the lines 1T1, 1T2 and 1T3 going to the pump motor 81. The pump motor control relay M1 has three sets of pump motor control contacts M1, one set being in each of the different phase leads to the pump motor 81 and a fourth set of relay coil holding contacts M1′ in a holding circuit 92 connected between the "stop" switch 89 and the "start" switch 90 to bypass the start switch 90 when the pump motor relay M1 is energized. A pump motor "run" light 94 is provided in a circuit 93 connected in parallel with the pump motor relay M1.

It will be understood that the pump motor 81 when energized operates a hydraulic fluid pump (not shown) for supplying pressurized fluid through suitable hydraulic fluid control circuits to selectively supply and exhaust fluid to and from the double acting fluid motor 33 (FIG. 2) through fluid conduits 33' and 33'' at opposite ends of the cylinder 34, for actuating the fluid motor 33. The fluid control circuits for the fluid motor 33 are conventional, for which reason they have not been illustrated or described in detail.

Parallel control circuits for the right and left ram elevation motors 69,69 are connected in series with a common line 95 including a master "on-off" switch 96 between the control current leads 86 and 87. The left ram elevation motor is selectively controlled by an up control circuit 97, and a down control circuit 98, while the right ram elevation motor is controlled by an up control circuit 97' and a down control circuit 98'. The up control circuit 97 includes the normally open "up" push button control switch 79, an upper limit switch LS1A, the normally closed contacts of a down relay M2D and the coil of an up relay M2U serially connected between the "on-off" switch 96 and the common lead 87. The down control circuit 98 includes the normally open push button switch 80, a lower limit switch LS1B, the normally closed contacts of the up relay M2U serially connected and paralleling the up control circuit 97. In series with both the up and down control circuits 97 and 98 and the side thereof adjacent to the common lead 87 are three sets of normally closed overload switch contacts OL, each responsive to an overload sensor in a different one of the phase leads to the left ram elevation motor 69 for breaking the motor control circuits and shutting off the left ram elevation motor when an overload condition is sensed.

Likewise the up control circuit 97' for the right ram motor 69 includes the normally open "up" push button control switch 79, a normally closed limit switch LS2A, normally closed contacts M3D of the down relay M3D and the energizing coil of up relay M3U serially connected between the "on-off" switch 96 and the common lead 87. The "down" control circuit 98' includes the normally open "down" control switch 80, the normally closed lower limit switch LS2B, the normally closed contacts M3U of the up relay M3U and the energizing coil of the down relay M3D serially connected and paralleling the up control circuit 97'. In series with both the up and down control circuits 97 and 98 and the side thereof adjacent to the common lead 87 are three sets of normally closed overload switch contacts OL, each responsive to an overload sensor in a different one of the phase leads to the right ram motor 69 for breaking the motor control circuits and shutting off the right ram motor when an overload condition in any one of the phases is sensed.

Leveling of the press brake ram 13 relative to the stationary bed 12 is accomplished by adjusting the lengths of the right and left ram leveling links 40,40 independently to selected lengths as indicated by the right and left hand indicator gages 72,72. This is done by independent control of the right and left ram elevation motors 69,69. Since both of the ram elevation motors 69,69 and their controls are similar, the operation of only the left ram elevation motor will be described in detail. Supposing that an operator determines that the left hand side of the ram is too low, he takes corrective action by closing the master switch 82 and moving the on-off switch in the circuit 95 to the on position. He then pushes the up control switch 79 located on the indicator housing 72 of the left ram link 40 to close the circuit 97 thus energizing the up relay M2U. Energizing the up relay M2U closes the M2U contacts in lines 2T1, 2T2 and 2T3 going to the left ram elevation motor 69 and supplies three phase electric current to the motor 69 in the proper manner to cause the motor to turn in the proper direction for shortening the left hand link 40. The operator can tell by watching the indicator gage 72 when the left hand link 40 has been shortened the proper amount and he will release the up button 79 when the proper position is reached. Preferably the ram elevation motors 69,69 include a brake which automatically brakes the motor shaft when the motor is deenergized, and automatically releases the shaft when the motor is energized. The up motor relay M2U includes a normally closed set of contacts in the down motor control circuit 98 which are opened upon energizing of the up relay. This assures that the down motor control circuit 98 will not be energized simultaneously with the up motor control circuit 97. If the operator should decide that the left side of the ram 13 should be lowered, he would press the down button 80, also on the indicator housing 72, thus closing the left ram elevation motor control circuit 98 and energizing the down relay M2D. Energizing the down relay M2D closes the three sets of contacts M2D going to the left ram elevation motor 69 and supplies three phase electric current to the left hand elevation motor 69 in the proper manner to cause the motor to turn in the proper direction for lengthening the left hand link 40. The down relay M2D has a set of normally closed contacts M2D in the up control circuit 97 which are opened upon the energizing of the down relay M2U thereby preventing the up control circuit 97 from being energized while the left hand elevation motor 69 is operating to lengthen the left hand link 40. The operator will stop the left ram elevation motor 69 at a selected lower position of the ram by observing the gage 72 and releasing the down push button 80 when the correct position is reached. Releasing the down push button breaks the down control circuit 98, deenergizes the down relay M2D and opens the M2D contacts in the left ram elevation motor leads, thus interrupting power to the left ram elevation motor 69. The up and down control circuits 97 and 98 include upper and lower limit switches LS1A and LS1B respectively which are physically associated with the left hand link 40 (at locations not shown) to establish limits for shortening and lengthening the left hand link 40. Likewise the up and down control circuits 97' and 98' include upper and lower limit switches LS2A and LS2B which are physically associated with the right hand link 40 to establish limits for shortening and lenghtening the right hand link 40.

If the right hand side of the ram must be adjusted, the operator adjusts the right hand link 40 in the same manner as has been described for adjusting the left hand link 40, but using the up and down push buttons 79 and 80 physically located on the right indicator housing 72 and included in the up and down right ram elevation motor control circuits 97' and 98' respectively shown in FIG. 9.

Once the proper level of the ram 13 is established, the press brake 10 is operated in the usual manner to bend metal sheets and bars. The pump motor 81 is actuated by pushing the start button 90 in the pump control circuit 91, thus energizing the pump motor relay M1 which in turn closes its contacts M1 in the pump motor leads and closes its holding circuit contacts M1' in the holding circuit 92 to bypass the start switch 90 and to keep the pump motor control circuit energized until the stop switch 89 is opened, or an overload in the pump circuit is sensed by one of the overload switches OL in the pump motor leads. The pump motor 81 actuates a pump (not shown) which selectively supplies pressurized hydraulic fluid through conventional controls to the fluid conduits 33' and 33" for actuating the fluid motor 33 (FIG. 2). Supply of pressurized fluid to conduit 33' and exhaust of fluid from conduit 33" causes the fluid motor 33 to extend the piston rod 37 to the right and thus to rotate the bell crank 26 clockwise about pivot pin 28. The tie link 30 causes the bell crank 27 to move in parallel motion with the bell crank 26 and thereby the ram 13 is lowered. The supply of pressurized fluid through the conduit 33" and the exhaust of fluid through conduit 33' causes the motor 33 to retract the piston rod 37 to the left and thus to rotate the bell crank 26 counterclockwise. Parallel motion of both bell cranks 26 and 27 in a counterclockwise direction will lift the ram 13 to the position shown in FIG. 5.

While in the foregoing there has been described and shown a preferred embodiment of the invention, various modifications and equivalents may be resorted to within the spirit and scope of the invention as claimed.

What is claimed is:

1. A press brake comprising an upstanding frame, a ram having opposite ends and hydraulic-mechanical power means for advancing and returning said ram, said power means including a pair of bell cranks each of which includes a fulcrum and first and second angularly related arms extending outwardly from said fulcrum and forming substantially a right angle therebetween, a pair of horizontally spaced pivot means for pivotally supporting said bell cranks about their fulcrums from said frame with said fulcrums at substantially the same level on said frame, hydraulic motor means connected between said frame and one of said bell cranks for oscillating said one bell crank about its fulcrum, link means pivotally interconnecting the first arm of said pair of bell cranks for causing parallel pivotal motion of said bell cranks, a pair of adjustable links pivotally supporting said ram from the second arm of said bell cranks, each link of said pair of adjustable links being independently adjustable in length for leveling said ram, and a pair of independently controlled reversible motor means for selectively lengthening and shortening each of said adjustable links.

2. The press brake according to claim 1 wherein each of said adjustable links includes a pitman having one end pivotally connected to said ram, and an opposite end provided with an axially inwardly extending socket, a threaded nut rotatably mounted within said socket, means for retaining said nut within said socket against axial displacement, a level adjusting screw having at one end external threads which threadedly engage said nut within said socket and having at its other end means for pivotally connecting said adjusting screw to the second arm of one of said bell cranks, said nut having external gear teeth thereon, a transverse opening extending through said pitman and opening into said socket adjacent the gear teeth of said nut, a worm shaft rotatably mounted within said transverse opening and having a worm gear operatively engaged with the external gear teeth of said nut for turning same, said motor means comprising a reversible motor operatively connected to said worm shaft for turning same and control means for selectively controlling said motor to cause rotation of said worm shaft and said nut in a selected direction to extend or shorten said adjustable link.

3. The press brake according to claim 2 together with a level adjustment indicator associated with each of said adjustable links, said level adjustment indicator including a zero set rotation counter having a counter input shaft and a plurality of counter wheels, and transmission means operatively connecting said worm shaft with said counter input shaft for rotating said counter input shaft, said counter being calibrated to provide a zero indication at the preselected normal level of the link associated with said counter, and to provide numerical indications of deviations from said normal level in opposite directions.

4. A press brake comprising an upstanding frame, a stationary bed, a ram having opposite end portions and power means for advancing and returning said ram relative to said stationary bed, said power means including a pair of horizontally spaced bell cranks, each having a fulcrum and a pair of angularly related lever arms intersecting each other at said fulcrum, a pair of horizontally spaced parallel pivots pivotally mounting said bell cranks on said frame to rotate in substantially the same plane, link means interconnecting said bell cranks for causing parallel motion thereof, motor means for oscillating said bell cranks, a pair of adjustable links connecting opposite end portions of said ram to corresponding lever arms of said pair of bell cranks, each link of said pair of adjustable links being independently adjustable in length for leveling said ram, and a pair of independently controlled reversible motor means for selectively lengthening and shortening said adjustable links, one of said reversible motor means being operatively associated with one of said adjustable links and the other of said reversible motor means being operatively associated with the other of said adjustable links.

5. The press brake according to claim 4 together with a pair of level adjustment indicators, there being one level adjustment indicator operatively associated with one of said adjustable links and the other of said indicators being operatively associated with the other of said adjustable links.

6. The press brake according to claim 4 wherein each of said adjustable links includes a first member having a socket therein, a nut rotatably mounted within said socket, a second member having external threads threadedly engaging said nut, the reversible motor means associated with each of said adjustable links including a reversible motor, drive means operatively connecting said reversible motor to said nut for turning same, and control means for selectively causing said reversible motor to turn in opposite directions.

7. A press brake comprising an upstanding frame, a stationary bed, a ram having opposite end portions, power means on said frame for advancing and retracting said ram relative to said stationary bed, and a pair of adjustable links operatively connecting opposite end portions of said ram with said power means, each link of said pair of adjustable links being independently adjustable in length for leveling said ram, and a pair of independently controlled reversible motor means for lengthening and shortening each of said adjustable links.

* * * * *